US005492544A

United States Patent [19]

Farng et al.

[11] Patent Number: 5,492,544

[45] Date of Patent: Feb. 20, 1996

[54] LUBRICANT COMPOSITIONS COMPRISING TOLYLTRIAZOLE-DERIVED TRI/TETRA ESTERS AS ADDITIVES FOR DISTILLATE FUELS

[75] Inventors: Liehpao O. Farng, Lawrenceville; Andrew G. Horodysky, Cherry Hill; Lloyd A. Nelson, Edison, all of N.J.

[73] Assignee: Mobil Oil Corporation, Fairfax, Va.

[21] Appl. No.: 265,256

[22] Filed: Jun. 29, 1994

[51] Int. Cl.[6] ..... C10L 1/22

[52] U.S. Cl. ..... 44/331; 44/332; 44/343

[58] Field of Search ..... 44/343, 332, 330, 44/331; 548/255, 257, 261, 262.2, 267.8

[56] References Cited

U.S. PATENT DOCUMENTS

| | | | |
|---|---|---|---|
| 4,148,605 | 4/1979 | Andress, Jr. | 252/51.5 A |
| 4,174,285 | 11/1979 | Braid | 252/51.5 A |
| 4,212,754 | 7/1980 | Chibnik | 252/49.7 |
| 4,282,007 | 8/1981 | Sung | 44/343 |
| 4,456,539 | 6/1984 | Shim | 252/46.7 |
| 4,791,206 | 12/1988 | O'Neil et al. | 548/108 |
| 4,834,776 | 5/1989 | Axelrod et al. | 548/547 |
| 5,183,475 | 2/1993 | Cardis et al. | 44/343 |
| 5,328,625 | 7/1994 | Farng et al. | 252/51.5 R |

*Primary Examiner*—Margaret Medley
*Attorney, Agent, or Firm*—Alexander J. McKillop; Malcolm D. Keen; Charles A. Malone

[57] ABSTRACT

Tolyltriazole derived esters of tri, tetra, and poly carboxylic acids or an acid generating compound have been found to be effective lubricity additives for lube oils, greases, or distillate fuels.

12 Claims, No Drawings

LUBRICANT COMPOSITIONS COMPRISING TOLYLTRIAZOLE-DERIVED TRI/TETRA ESTERS AS ADDITIVES FOR DISTILLATE FUELS

FIELD OF THE INVENTION

This invention is directed to tolyltriazole-derived tri/tetra acid esters which demonstrate enhanced solubility for use as lubricity agents in distillate fuels.

BACKGROUND OF THE INVENTION

The use of triazole derivatives, such as benzotriazole, and 1,2,4-triazole, have been well known for their anticorrosion, metal passivating properties as well as biological properties in a variety of lubricant applications, as disclosed in U.S. Pat. Nos. 4,791,206 and 4,456,539, and fungicide/biocide applications. Tolyltriazole has corrosion inhibitor qualities as well as being a metal passivator. However, its use has been limited due to poor solubility in fuels and lubes.

Applicants' allowed co-pending application Ser. No. 07/986,655, which was filed on Dec. 8, 1992, is directed to triazole-derived acid-ester or ester-amide-amine derivatives which are converted to their corresponding diester, amide-ester salts by reaction with an amine, hydroxy or hydroxylamine compounds.

The use of carboxylic acids, such as oleic acid, and the use of succinic anhydride derivatives, such as dodecenyl succinic anhydride-alcohol adduct, have been extensively reported as having beneficial antirust properties as well as detergency/dispersancy characteristics. Carboxylic acids and esters have been used as corrosion and lubricity agents in jet fuels. Tolyltriazole/alkyl epoxide derived esters of dicarboxylic acids have been used as antiwear agents in lubricants.

Superior benefits of these epoxide derived esters have not been obtained because of limited solubility in fuels and lubes.

Therefore, what is needed is a composition and process for making said composition which will enhance the solubility of epoxide derived esters to obtain improved lubricity when an additive containing said composition is incorporated into lube oils, greases, or distillate fuels. What is also needed is a composition and process for enhancing the desirable performance benefits of such epoxide derived esters.

SUMMARY OF THE INVENTION

This invention is directed to a product, composition, and method for producing a lube oil, grease, or distillate fuel additive of tolyltriazole/alkyl epoxide derived ester of dicarboxylic acids.

The composition comprises a major proportion of a liquid hydrocarbon or oxygenated fuel or mixtures thereof or an oil of lubricating viscosity or grease prepared therefrom and a minor proportion of a multifunctional solubility improving, antiwearing, load carrying/EP, metal deactivating, antioxidating, emulsifying, antistaining additive product of reaction prepared by reacting (1) a triazole or hydrocarbyl substituted triazole with a hydrocarbyl oxide to form a triazole-derived alcohol and thereafter (2) reacting said triazole-derived alcohol with a tri, tetra, or poly carboxylic acid or anhydride, or carboxylic acid halide or acid ester generating compound thereby producing a tolyltriazole/alkyl epoxide derived tri, tetra, or poly ester of dicarboxylic acids.

The reaction can be carried out with a catalytic amount of a hydrocarbyl sulfonic acid or other acidic esterification catalyst at temperatures varying from ambient to about 250° C. under ambient or autogenous pressures, in molar ratios of reactants varying from equimolar to more than molar to less than molar for a time sufficient to obtain the desired additive product of reaction.

It is therefore an object of this invention to provide for small concentrations of reaction products of citric acid/alkyl epoxide, and tolyltriazole which posses excellent lubricity and antiwear properties when incorporated into gasoline, diesel, and jet distillate fuels.

It is another object of this invention to provide for products of reaction which contain hydroxyl, carboxylate, and heterocyclic amine groups in one molecule to obtain a synergistic combination of antiwear, metal deactivation, cleanliness, and corrosion inhibition properties.

It is a further object of this invention to provide for reaction products which additionally impart wax-antisettling, low temperature fluidity, extreme pressure (EP) activity, antifatigue performance, corrosion inhibition, friction reduction, antistaining, antioxidant and demulsibility qualities to distillate fuels and lubricants.

It is yet another object of this invention to enhance the solubility and polarity of tolyltriazole/alkyl epoxide derived ester of dicarboxylic acids by the incorporation of alkyl chains of specific range and use of tri or tetra acid ester generating species.

It is another further object of this invention to provide for small concentrations of reaction products mentioned above for incorporation into lubricants such as lube oils and greases to impart similar properties and qualities thereto.

It is a still further object of this invention to provide for small concentrations of the reaction products mentioned above for incorporation into liquid fuels, gasoline and diesel fuels to impart similar properties and qualities thereto.

DESCRIPTION OF THE PREFERRED EMBODIMENTS

In the practice of this invention, triazoles (benzotriazole, tolyltriazole, or 1,2,4-triazole, etc.) were reacted with alkylene oxides, e.g., 1,2-epoxyhexadecane, etc., to form triazole-derived alcohols as described below.

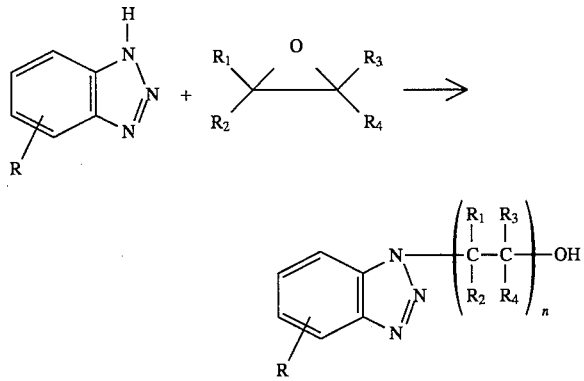

where R is hydrogen or $C_1$ to $C_{24}$ hydrocarbyl or hydrocarbyloxy-hydrocarbylene or mixtures thereof; where $R_1$, $R_2$, $R_3$, $R_4$ are hydrogens or $C_1$ to $C_{30}$ hydrocarbyl, and can optionally contain additional sulfur, oxygen and/or nitrogen n=1 to 20.

When molar, less than molar, or more than molar quantities of the resultant alcohols are reacted with tri, tetra, or poly carboxylic acids or acid ester generating species, molecules are formed which have the following structures. The mixtures formed by these structures result in expected products of which the structures below are a few representatives thereof.

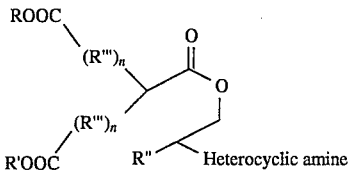

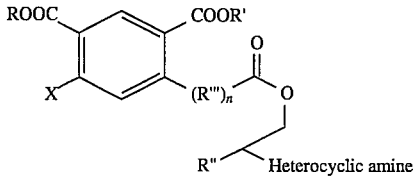

where R'' equals $C_8$ to $C_{24}$ hydrocarbon, R' and R equals hydrogen or hydrocarbyl or both, R''' equals $C_1$, or hydrocarbyl or additionally contains a hydroxyl or ethene group, X equals hydrogen, carboxylic acid or an ester, and n equals 0 or 1.

The molecules that are formed are more generally represented by the following structures below which are representative only.

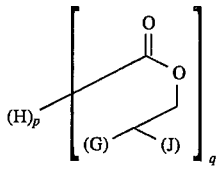

where p and q are integers and p+q=3 to 8; G comprises at least one hydrocarbyl which optionally may contain S, O, or N; H is a carboxylate, or hydrocarbyl derived carboxylate that may additionally contain acid, ester, or amide groups; J is a heterocyclic amine linked to a carboxylate group as an ester or amide linking group, where the heterocyclic amine is derived from triazole-derived alcohols; and where J may also contain additional hydrocarbyl groups and may optionally contain S, O, and/or N.

In carrying out the reaction, less or more than molar quantities of tolyltriazole, alkyl epoxide, and tri, tetra, or poly carboxylic acids or such acid generating species can be used. Reaction temperatures of 150° C. and below are adequate. The reaction time can vary from about 2 to 24 hours.

Tri, tetra, or poly carboxylic acids and mixtures thereof or acid ester generating species that can be used include pyromellitic dianhydride, trimellitic anhydride, benzophenone, tetra-carboxylic dianhydride and citric acid.

Any suitable triazole or alkylene oxide may be used in the practice of this invention. The preferred triazole and alkylene oxide comprises tolytriazole and 1,2-epoxyhexadecane.

Suitable alkylene oxides include but are not limited to the following: 1,2-epoxyhexandecane, 1,2-epoxybutane, 1,2-epoxypropane, ethylene oxide, 1,2-epoxyhexane, 1,2-epoxydecane, 1,2-epoxyoctane, 1,2-epoxydodecane, epoxidized soybean oil, epoxidized octyl soyate, epodized linseed oil and mixtures thereof. Suitable epoxides can optionally contain additional sulfur, oxygen, and/or nitrogen.

Other triazoles include but are not limited to benzotriazole, 1,2,4,-triazole, tolyltriazole, dodecylbenzotriazole, carboxybenzotriazole and 4,5,6,7-benzotriazole and mixtures thereof.

The use of small concentrations of the reaction products of citric acid/alkyl epoxide, and tolytriazole possess excellent lube oil, grease, or distillate fuel lubricity, and antiwear properties. The hydroxyl, carboxylic acid, and heterocyclic amine groups are believed to provide a synergistic combination of antiwear, metal deactivation, cleanliness, and corrosion inhibition properties. The presence of the alkyl moiety is believed to provide enhanced fuel solubility. Enhanced fuel solubility of these additive reaction products is obtained by incorporation of alkyl chains of a specific range of $C_8$– $C_{24}$, or on occasion, more preferably ($C_{12}$–$C_{18}$), and the use of tri or tetra acid ester generating species. When the tri, tetra, or poly acid generating species contains one or more aromatic groups, additional cleanliness features are expected due to the additional solvency and polarity of the resultant composition. The additives described may also provide low-temperature improving and wax-antisettling properties, extreme pressure activity, antifatigue performance, corrosion inhibition, friction reduction, antistaining, antioxidant and emulsibility qualities.

The beneficial effects observed in the compositions are believed to be a result of an internal synergism. These effects should be applicable to similar structures containing (a) carboxylic acid, (b) hydroxyl, (c) heterocyclic amine, and (d) a lipholizer within the same molecule. These compositions can also be used in the presence of other commonly used additives in diesel fuel compositions. Use in other fuels such as gasoline and jet fuels are expected to provide similar results. The gasoline may contain oxygenated compounds such as alcohols or ethers. These compositions can also be used in lubricants to provide many of the same beneficial properties.

Generally speaking, conditions for the above described reactions may vary widely depending upon specific reactants, the presence or absence of a solvent and the like. Any suitable set of reaction conditions known to the art may be used. Generally, stoichiometric quantities of reactants are used. However, equimolar, more than molar or less than molar amounts may be used without detracting from the invention. An excess of up to 100% or more of any of the reactants can be used. Preferably, the molar ratio varies from about 10:10:10:0 moles to about 1:1:10:10 moles respectively of triazole/alkylene oxide/tri, tetra, or poly carboxylic acid ester generating compound/reactive compound so that a sufficient amount of carboxylate remains during the reaction to obtain the desired reaction products. The reaction temperature may vary from ambient to about 250° C. or reflux, the pressure may vary from ambient or autogenous to about 500 psi. A catalytic amount of an acidic reaction hydrocarbyl sulfonic acid such as p-toluenesulfonic acid may also be utilized.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt % based on the total weight of the composition can be used. Preferably, the concentration is from 0.1 to about 3 wt. %.

The additives have the ability to improve the above noted characteristics of various oleaginous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SUS at 100° F. to about 6,000 SUS at 100° F. and preferably, from about 50 to about 250 SUS at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, alkylated aromatics, alkylated heterocyclics, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, and phenoxy phenylethers and mixtures thereof.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, non-metallic or metallic phosphorodithioates and the like. These materials do not detract from the value of the compositions of this invention, rather the materials serve to impart their customary properties to the particular compositions in which they are incorporated.

The additives in accordance with the invention are believed to be highly useful in fuel compositions, particularly in liquid hydrocarbon fuels or oxygenated fuels such as alcoholic fuels, ether-containing fuels, and the like and mixtures thereof. Exemplary alcoholic fuels may comprise gasoline containing methanol, ethanol, or propanol and mixtures thereof or ethers such as t-butylmethyl ethers. The present additives are used in fuel compositions in amounts ranging from about 1 to about 1,000 pounds of additive per 1,000 barrels of fuel and preferably from about 10 to about 250 pounds per 1,000 pounds of fuel. In addition to liquid hydrocarbon and oxygenated combustion fuels, distillate fuels and fuel oils are also contemplated.

The composition of this invention may also be used in conjunction with other fuel antiwear, detergent, cleanliness, low-temperature fluidity improving, octane improving, cetane improving, anticorrosion, antistaining, metal deactivating, combustion improving, antioxidant, fiction reducing, and demulsifying compositions.

The following examples are merely illustrative and are not meant to be limitations.

EXAMPLE 1

Reaction Product of Tolytriazole, 1,2-Epoxydodecane and Citric Acid 40.0 gm (0.3 mol) of tolytriazole was charged into a 1 liter four-neck reactor equipped with dropping funnel, reflux condenser, thermometer, and mechanical stirrer. Approximately 100 ml toluene was added into the reactor to make a suspension.

Approximately 72 gm (0.4 mol) of 1,2-epoxydodecane (commercially obtained from Viking Chemical Company under the trade name "VIKOLOX" 12) was cautiously added dropwise to the suspension at 60°–65° C. over a course of one hour. At the end of the addition, 57.6 gm (0.3 mol) of citric acid was added at a temperature of 65° along with a catalytic amount, 0.19 gm (1 mmol) of p-toluenesulfonic acid. A nitrogen sparger inlet was used to replace the dropping funnel in the four-neck reactor. This mixture was heated to 160° C to obtain azeotropic removal of 5 ml of water. At the end of the reaction, the reaction mixture was cooled down and stripped of volatiles by reduced pressure distillation thereby obtaining 145 gm of residue.

EXAMPLE 2

Reaction Product of Tolyltriazole, 1,2-Epoxyhexadecane, and Citric Acid 40.0 gm (0.3 mol) of tolytriazole was charged into a 1 liter four-neck reactor equipped with dropping funnel, reflux condenser, thermometer, and mechanical stirrer. Approximately 100 ml toluene was added into the reactor to make a suspension.

Approximately 72 gm (0.3 mol) of 1,2-epoxyhexadecane (commercially obtained from Viking Chemical Company [ATOCHEM] under the trade name "VIKOLOX" 16) was cautiously added dropwise to the suspension at 60°–65° C. over the course of one hour to obtain intermediate A. Thereafter, 38.4 gm (0.2 mol) of citric acid was added to intermediate A at 65° C. along with a catalytic amount, 0.19 gm (1 mmol) of p-toluenesulfonic acid. The mixture was heated to 160° C. for 16 hours thereby obtaining azeotrophic removal of 4.6 ml of water. At the end of the reaction, the reaction mixture was cooled down and stripped of volatiles by reduced pressure distillation to obtain 124 gm of residue.

EVALUATION OF PRODUCTS

The product of the above Examples was blended into fully formulated middle distillate base fuel and evaluated for antiwear performance using the Four-Ball test (ASTM Method D-2266, Table 1).

TABLE 1

| FOUR-BALL WEAR TEST RESULTS (10 kg, 600 rpm, 30 min., 50° C.) | | | |
|---|---|---|---|
| Item | Additive Conc. (wt %) | Wear Scar Diameter (mm) | Wear Volume (K-Factor) (X10E8) |
| Middle distillate base fuel | 0.00 | 0.58 | 48.6 |
| Example 1 in above base fuel | 0.10 | 0.247 | 1.4 |
| Commercial antiwear additive in above base fuel | 0.10 | 0.258 | 1.80 |
| Commercial antiwear additive in above base fuel | 0.10 | 0.511 | 42.59 |

The "K" factor is a dimentionless number related to the wear volume. Smaller numbers are highly desirable.

TABLE 2

| FOUR-BALL WEAR TEST RESULTS (10 kg, 600 rpm, 30 min., 50° C.) | | | |
|---|---|---|---|
| Item | Additive Conc. (wt %) | Wear Scar Diameter (mm) | Wear Volume (K-Factor) (X10E8) |
| Low Sulfur Middle Distillate base Fuel | 0.00 | 0.428 | 20.12 |
| Intermediate A (example 2) in above base Fuel | 0.10 | 0.364 | 9.93 |
| Example 2 in above base fuel | 0.10 | 0.317 | 5.22 |

As shown above, the products of this invention demonstrate considerable EP activity as evidenced by the improvement of the wear scar diameters and wear volumes.

Although these products have demonstrated significant antiwear/EP activity, they are extremely non-corrosive to metals, such as copper alloys, as evidenced by the copper strip corrosivity performance. Copper strip corrosivity ratings of 1A and 1B can be obtained with fuel and lubricant compositions containing the structures of this invention.

The use of additive concentrations of this invention in fuels will significantly reduce fuel pump and injector components wear problems associated with low sulfur and low aromatics containing fuels. They will also improve the combustion properties of these fuels and as such reduce particulate emissions. These additives potentially may benefit fuel and lubricant properties by reducing hydrocarbon, carbon monoxide, and NOx emissions, and by improving antiwear and fuel economy characteristics and extending engine life.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed:

1. An improved liquid fuel composition comprising a major proportion of a liquid hydrocarbon fuel or oxygenated fuel or mixtures thereof and a minor proportion of an additive product of reaction prepared by reacting (1) a triazole or hydrocarbyl substituted triazole with a hydrocarbyl oxide which optionally contains N, S, O to form a triazole-derived alcohol and thereafter (2) reacting said triazole-derived alcohol with a tri, tetra, or poly carboxylic acid or an acid ester generating compound thereby producing a tolyltriazole/alkyl epoxide derived tri, tetra, or poly ester of dicarboxylic acids or acid generating species wherein the reaction can be optionally carried out with a catalytic amount of an acidic reacting catalyst at temperatures varying from ambient to about 250° C. under ambient or autogenous pressures, in molar ratios of reactants varying from equimolar to more than molar to less than molar of 1) and 2) above where free carboxylate remains in the reaction for a time sufficient to obtain the desired additive product of reaction.

2. The composition of claim 1 wherein the triazole is triazole or tolyltriazole, the hydrocarbyl oxide is 1,2-epoxydodecane, the tri, tetra, or poly carboxylic acid is citric acid, and the catalyst is p-toluenesulfonic acid.

3. The composition of claim 1 wherein the tri, tetra, or poly carboxylic acid or acid ester generating compound is selected from a member of the group consisting of pyromellitic dianhydride, trimellitic anhydride, benzophenone tetra-carboxylic dianhydride or citric acid and mixtures thereof.

4. The composition of claim 1 wherein the tolyltriazole/alkyl epoxide derived ester of dicarboxylic acids is represented by the following structure

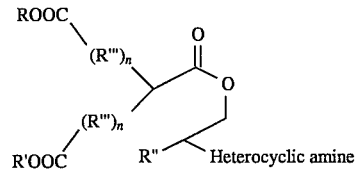

where R'' equals $C_8$–$C_{24}$ hydrocarbon, R' and R equals hydrogen, R''' equals $C_1$ or hydrocarbyl which optionally contains a hydroxyl or ethene group, and n equals 0 to 1.

5. The composition of claim 1 wherein the tolyltriazole/alkyl epoxide derived ester of dicarboxylic acids is represented by the following structure

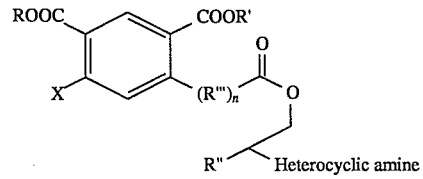

where R'' equals $C_8$ to $C_{24}$ hydrocarbon, R' and R equals hydrogen R''' equals $C_1$ or hydrocarbyl which additionally contains a hydroxyl or ethene group, X equals hydrogen, carboxylic acid or an ester, and n equals 0 to 1.

6. The composition of claim 1 wherein said fuel contains from about 1 to 1,000 pounds of additive per 1,000 barrels of fuel based on the total weight of the composition of the additive product of reaction.

7. The composition of claim 1 wherein said fuel is selected from a member of the group consisting of jet fuel, diesel fuel, gasoline, and gasoline mixtures containing methanol or ethanol.

8. The composition of claim 1 wherein said fuel is diesel fuel.

9. The composition of claim 1 wherein the reactants are tolyltriazole, and 1,2-epoxydodecane, pyromellitic dianhydride, and p-toluenesulfonic acid.

10. The composition of claim 1 wherein the reactants are tolyltriazole, 1,2-epoxyhexadecane, citric acid, and p-toluenesulfonic acid.

11. The composition of claim 1 where the acidic reaction catalyst is a hydrocarbyl sulfonic acid.

12. The composition of claim 1 where the acidic reaction catalyst is p-toluenesulfonic acid.

* * * * *